US010614781B2

(12) United States Patent
Ichiki

(10) Patent No.: US 10,614,781 B2
(45) Date of Patent: Apr. 7, 2020

(54) KEYBOARD DEVICE AND ELECTRONIC KEYBOARD DEVICE

(71) Applicant: YAMAHA CORPORATION, Hamamatsu-shi (JP)

(72) Inventor: Shunsuke Ichiki, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 16/130,244

(22) Filed: Sep. 13, 2018

(65) Prior Publication Data

US 2019/0012991 A1 Jan. 10, 2019

Related U.S. Application Data

(63) Continuation of application No. PCT/JP2017/010007, filed on Mar. 13, 2017.

(30) Foreign Application Priority Data

Mar. 25, 2016 (JP) ..... 2016-061703

(51) Int. Cl.
*G10C 3/12* (2006.01)
*G10H 1/34* (2006.01)

(52) U.S. Cl.
CPC ..... *G10C 3/12* (2013.01); *G10H 1/34* (2013.01); *G10H 1/346* (2013.01)

(58) Field of Classification Search
CPC ..... G10C 3/12; G10H 1/34; G10H 1/346
See application file for complete search history.

(56) References Cited

U.S. PATENT DOCUMENTS 4,914,999 A * 4/1990 Masubuchi ..... G10C 3/12 200/5 A
5,574,241 A 11/1996 Kumano
5,929,357 A 7/1999 Masubuchi
6,002,078 A * 12/1999 Yoshinaga ..... G10H 1/344 84/423 R (Continued)

FOREIGN PATENT DOCUMENTS

JP 0349595 U 5/1991
JP 2000330568 A 11/2000

(Continued)

OTHER PUBLICATIONS

English translation of Written Opinion issued in Intl. Appin. No. PCT/JP2017/009902 dated May 23, 2017, previously cited in IDS filed Sep. 13, 2018.

(Continued)

*Primary Examiner* — Robert W Horn
(74) *Attorney, Agent, or Firm* — Rossi, Kimms & McDowell LLP

(57) ABSTRACT

A keyboard device is provided. The keyboard device includes a key and a connection portion connected between the key and a frame. The connection portion possess a first region and second regions. The first region extends in a key-longitude direction and has a smaller width than the key in a scale direction. The second regions are arranged so as to be lined in front of and behind the first region in the key-longitude direction, have flexibility in a yawing direction, and have narrower widths than the first region in a scale direction.

17 Claims, 9 Drawing Sheets

(56) References Cited

U.S. PATENT DOCUMENTS

| | | | | |
|---|---|---|---|---|
| 6,051,768 | A * | 4/2000 | Masubuchi | G10C 3/12 84/423 R |
| 6,133,517 | A * | 10/2000 | Masubuchi | G10C 3/12 84/423 R |
| 6,147,290 | A | 11/2000 | Uno | |
| 6,156,963 | A * | 12/2000 | Masubuchi | G10C 3/12 84/423 R |
| 6,369,309 | B1 * | 4/2002 | Nishida | G10C 3/12 84/423 R |
| 7,141,729 | B2 | 11/2006 | Uno | |
| 7,208,668 | B2 | 4/2007 | Shimoda | |
| 7,297,854 | B2 * | 11/2007 | Nishida | G10C 3/12 84/423 R |
| 7,297,855 | B2 * | 11/2007 | Nishida | G10C 3/12 84/423 R |
| 7,332,663 | B2 * | 2/2008 | Nishida | G10C 3/12 84/423 R |
| 7,465,863 | B2 * | 12/2008 | Nishida | G10C 3/12 84/423 R |
| 7,476,795 | B2 * | 1/2009 | Toyama | G10C 3/12 84/423 R |
| 7,485,798 | B2 * | 2/2009 | Nishida | G10C 3/12 84/18 |
| 7,544,876 | B2 * | 6/2009 | Toyama | G10C 3/12 84/423 R |
| 7,586,030 | B2 * | 9/2009 | Nishida | G10C 3/12 84/423 R |
| 7,683,247 | B2 * | 3/2010 | Nishida | G10C 3/12 84/423 R |
| 7,750,222 | B2 | 7/2010 | Osuga | |
| 8,003,871 | B2 * | 8/2011 | Kitajima | G10C 3/12 84/423 R |
| 8,110,732 | B2 | 2/2012 | Shimoda | |
| 9,281,142 | B2 | 3/2016 | Sawada | |
| 9,406,284 | B2 * | 8/2016 | Yoshizaki | G10C 3/12 |
| 9,449,586 | B2 * | 9/2016 | Yamamoto | G10C 3/12 |
| 10,115,382 | B2 | 10/2018 | Nishimura | |
| 10,510,329 | B1 * | 12/2019 | Yasuda | G10H 1/34 |
| 2004/0261598 | A1 | 12/2004 | Uno | |
| 2005/0056138 | A1 | 3/2005 | Osuga et al. | |
| 2014/0000444 | A1 | 1/2014 | Kaneko | |
| 2018/0286368 | A1 | 10/2018 | Tanoue | |
| 2019/0012991 | A1 * | 1/2019 | Ichiki | G10H 1/34 |
| 2019/0043459 | A1 | 2/2019 | Ichiki | |

FOREIGN PATENT DOCUMENTS

| | | | |
|---|---|---|---|
| JP | 2001166773 | A | 6/2001 |
| JP | 2002073029 | A | 3/2002 |
| JP | 2006038941 | A | 2/2006 |
| JP | 2008191650 | A | 8/2008 |
| JP | 2011221560 | A | 11/2011 |
| JP | 2011253040 | A | 12/2011 |
| JP | 2012189872 | A | 10/2012 |

OTHER PUBLICATIONS

English translation of Written Opinion issued in Intl. Appin. No. PCT/JP2017/010007 dated May 23, 2017, previously cited in IDS filed Sep. 13, 2018.

International Search Report issued in Intl. Appln. No. PCT/JP2017/010007 dated May 23, 2017. English translation provided.

Written Opinion issued in Intl. Appin. No. PCT/JP2017/010007 dated May 23, 2017.

International Search Report issued in Intl. Appln. No. PCT/JP2017/009902 dated May 23, 2017. English translation provided.

Written Opinion issued in Intl. Appin. No. PCT/JP2017/009902 dated May 23, 2017.

Copending U.S. Appl. No. 16/130,096, filed Sep. 13, 2018.

Notice of Allowance issued in U.S. Appl. No. 16/130,096 dated Sep. 13, 2019.

Notice of Allowance issued in U.S. Appl. No. 16/130,096 dated Nov. 7, 2019.

* cited by examiner

KEYBOARD DEVICE AND ELECTRONIC KEYBOARD DEVICE

CROSS REFERENCE TO RELATED APPLICATIONS

This application is a U.S. continuation application filed under 35 U.S.C. § 111(a), of International Application No. PCT/JP2017/010007 filed on Mar. 13, 2017, which claims priority to Japanese Patent Application No. 2016-061703 filed on Mar. 25, 2016, the disclosures of which are incorporated by reference.

FIELD

The present invention relates to a technology for a keyboard device and an electronic keyboard device using the keyboard device.

BACKGROUND

Japanese Patent Application Publication No. 2008-191650 discloses a technology relating to a keyboard device including a key, a horizontal hinge portion of a thin plate having a surface and back surface extending in a horizontal direction, and a vertical hinge of a thin plate having a surface and back surface extending in a vertical direction. According to this structure, flexibility in a scale direction is improved by the vertical hinge.

SUMMARY

According to an embodiment of the present invention, a keyboard is provided. The keyboard possesses a key and a connection portion. The connection portion includes a first region having lower rigidity than that of the key and two second regions sandwiching the first region and having lower rigidity than that of the first region. The key is connected to one of the second regions.

According to an embodiment of the present invention, a keyboard device is provided which possesses a key and a connection portion. The connection portion includes: a first region extending in a key-longitude direction and having a width narrower than the key in a scale direction; and second regions lined in front of and behind the first region in the key-longitude direction, having flexibility in a yawing direction, having narrower widths than the first region in a scale direction, and connected between the key and a frame.

According to an embodiment of the present invention, a keyboard device is provided which possesses a key and a connection portion connected between the key and a frame. The connection portion includes: a first region extending in a key-longitude direction and having rigidity lower than the key in a scale direction; and second regions lined in front of and behind the first region in the key-longitude direction, having flexibility in a yawing direction, and having lower rigidity than the first region in the scale direction.

According to an embodiment of the present invention, an electronic keyboard device is provided including the keyboard device; a sensor sensing a strike on the key; and a sound-source portion generating a sound-wave signal according to an output signal of the sensor.

BRIEF DESCRIPTION OF DRAWINGS

FIG. 7A and FIG. 7B are drawings of a keyboard device according to a modified example of the First Embodiment of the present invention while FIG. 7A and FIG. 7B are side views showing a positional relationship between a white key and a hammer when the white key is in an unstruck state and a struck state, respectively;

DESCRIPTION OF EMBODIMENTS

Hereinafter, an electronic keyboard instrument 500 according to an embodiment of the present invention is explained in detail with reference to the drawings. Embodiments described below are merely examples of the embodiments, and the present invention is not limited to these embodiments.

First Embodiment

1. Outline Structure

Figure 1:
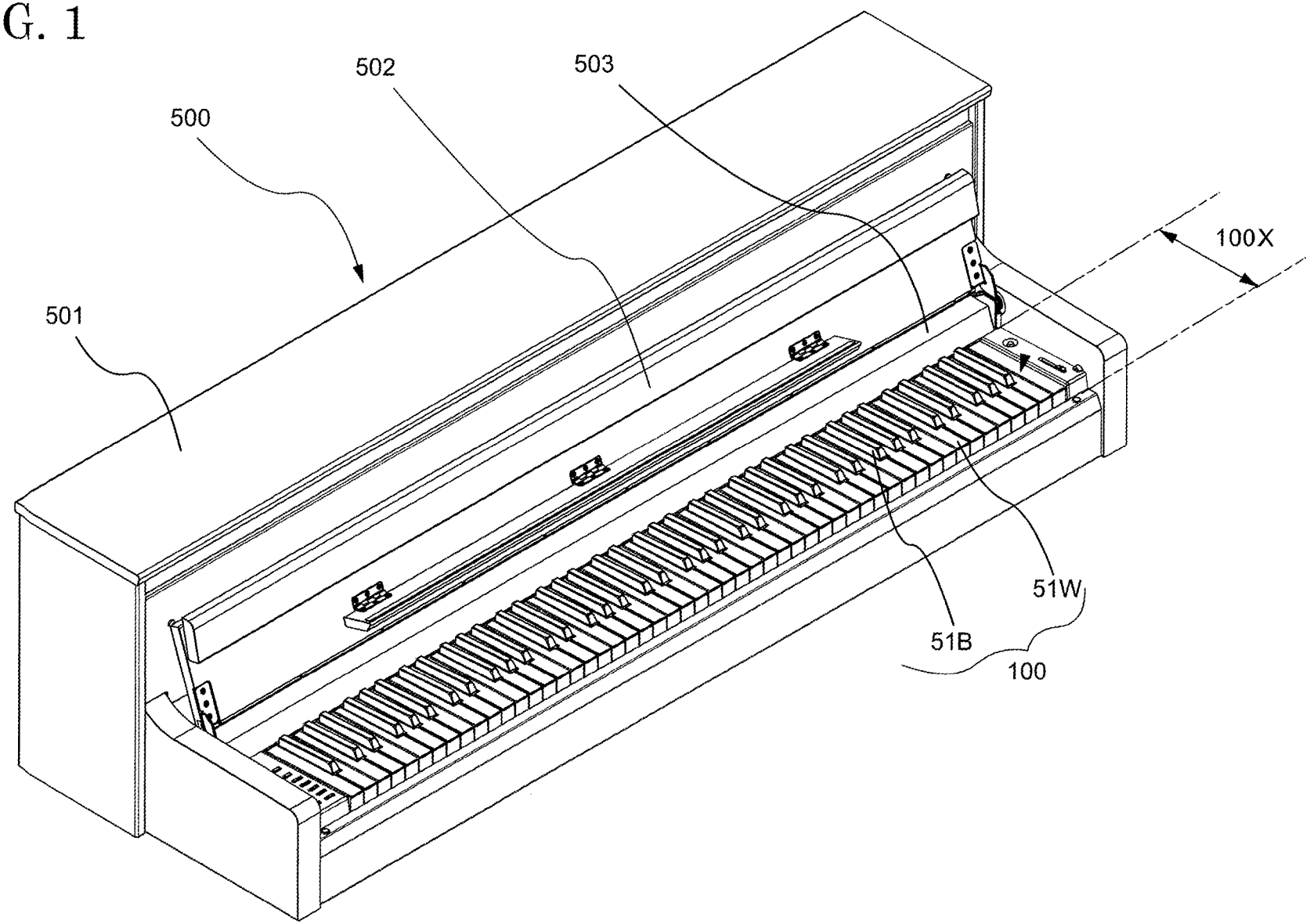
FIG. 1 is a perspective view of an electronic keyboard instrument having a keyboard device according to the First Embodiment of the present invention.

FIG. 1 is a perspective view of the electronic keyboard instrument 500 including a keyboard device 100 according to the First Embodiment of the present invention. As shown in FIG. 1, the electronic keyboard instrument 500 possesses a housing 501, the keyboard device 100 having white keys 51W and black keys 51B, a cover 502, and a cover 503.

The keyboard device 100 is attached to the housing 501. The cover 502 can be opened and closed with respect to the housing 501 and is configured to cover the whole of the keyboard device 100 in the closed state. The cover 503 is fixed without being moved with respect to the housing 501 and configured to cover a part of the keyboard device 100. The keyboard device 100 has an outward portion 100X which is not covered by the cover 503 and a non-outward portion 100Y covered by the cover 503 (see FIG. 2).

Figure 2:
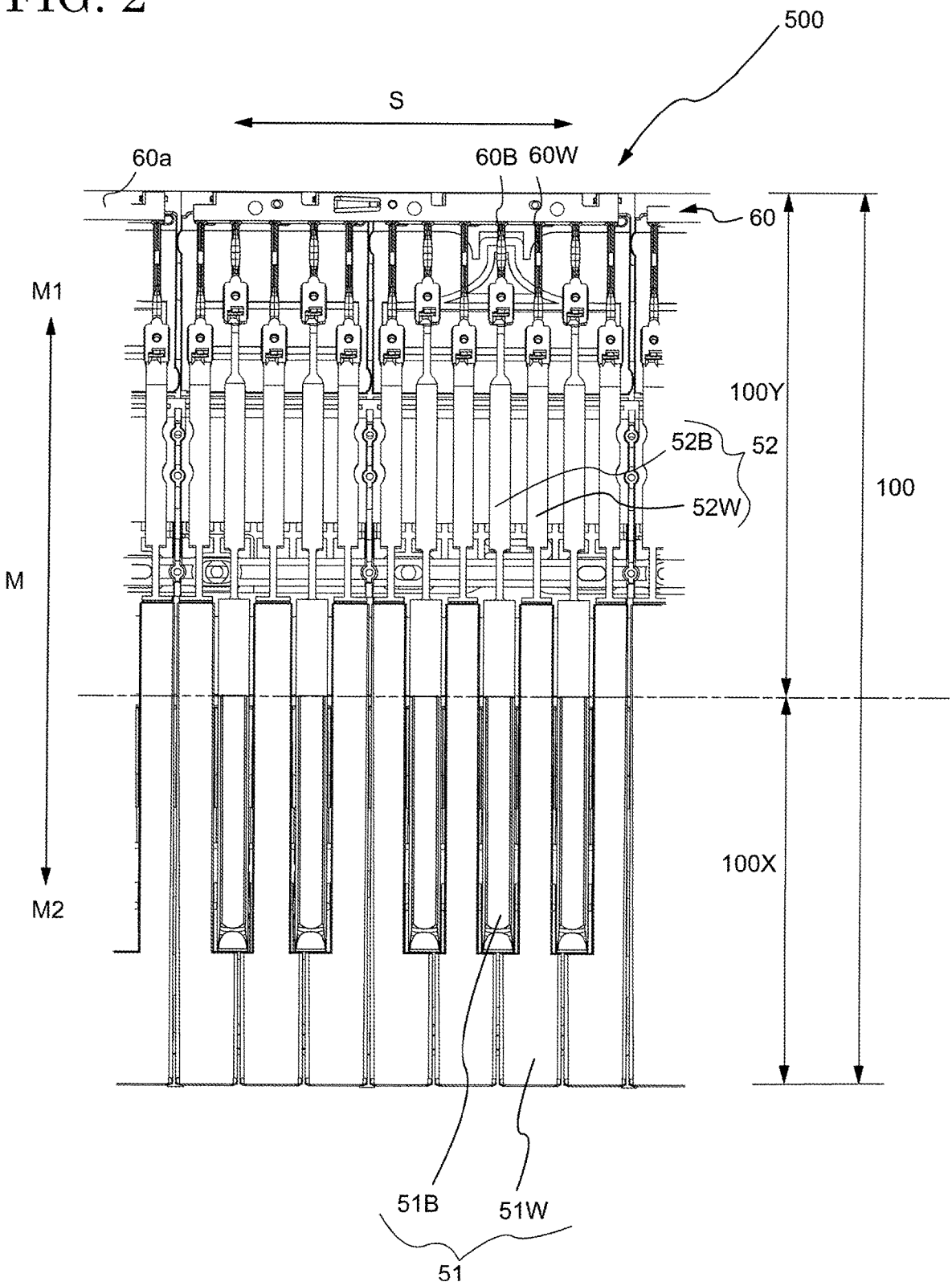
FIG. 2 is an enlarged plane view of a part of the electronic keyboard instrument.

FIG. 2 is an enlarged plane view of a part of the electronic keyboard device 500. In the following explanation, a direction from a player to a far side from the player along a key-longitude direction M of the keyboard device 100 is called a key-longitude back direction M1, and a direction from the far side from the player to the player is called a key-longitude front direction M2.

In the keyboard device 100, the keys 51 (white keys 51W and black keys 51B), connection portions 52 (white-key connection portions 52W and black-key connection portions 52B), and a frame 60 are arranged in this order from the front side to the far side in the key-longitude direction M. The keys 51 are portions which are struck by a user. The connection portions 52 are portions extending from the keys 51 in the key-longitude back direction M1 and connected between the keys 51 and the frame 60. A plurality of structures in which the key 51 and the connection portion 52 are connected is arranged to line up in a scale direction S.

The frame 60 is arranged at a position on a side of the key-longitude back direction M1 from the connection portion 52 in the key-longitude direction M. The frame 60 possesses a supporting portion 60*a*, a guide for the keys 51W and 51B, and the like. A plurality of frame narrow-width portions 60W and a plurality of frame narrow-width portions 60B are provided in the frame 60. The supporting portion 60*a* is a portion extending in the scale direction S. The frame narrow-width portions 60W and the frame narrow-width portions 60B extend from the supporting portion 60*a* in a direction intersecting the scale direction S. Note that, in the present specification and the claims, the "frame" includes the supporting portion 60*a* but does not include the frame narrow-width portions 60W and 60B, while the frame narrow-width portions 60W and 60B are included in the "connection portions". The scale direction S means a direction perpendicular to the key-longitude direction M and parallel to a top surface of the key 51.

A part of the key 51 corresponding to the outward portion 100X of the keyboard device 100 is arranged in an area visible from the outside (see also FIG. 1). The other portion of the key 51 and the connection portion 52 which correspond to the non-outward portion 100Y of the keyboard device 100 are arranged in an area covered by the cover 503 and invisible from the outside (see also FIG. 1).

2. Frame

Figure 3:
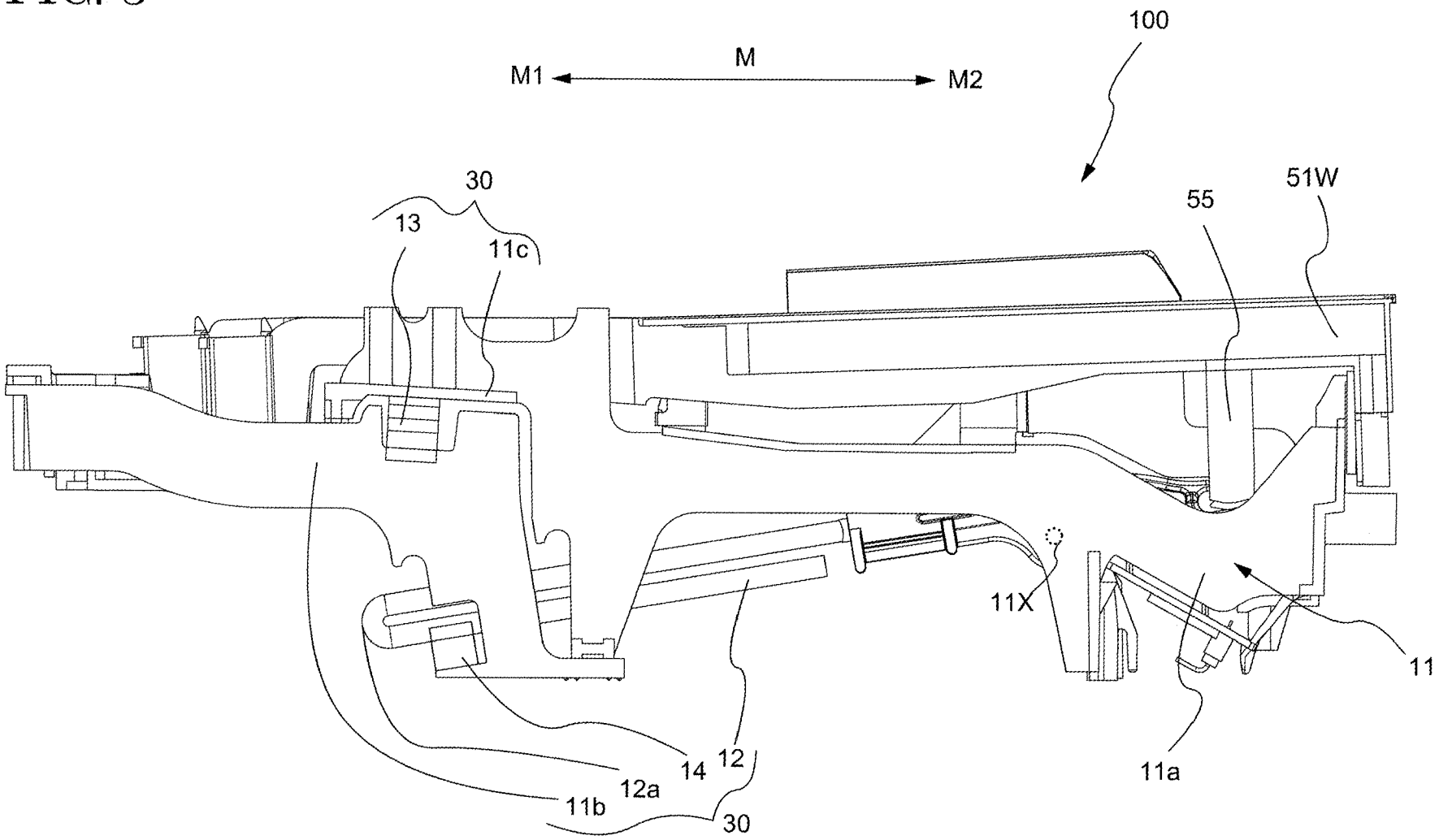
FIG. 3 is a side view of a keyboard device.

FIG. 3 is a side view of the keyboard device 100 obtained when the white key 51W is observed sidewise. As illustrated in FIG. 3, a frame 11 has a supporting-frame portion 11*a*, a supporting-frame portion 11*b*, and a supporting-frame portion 11*c*. The supporting-frame portion 11*b* and the supporting-frame portion 11*c* are fixed to the supporting-frame portion 11*a*, and the supporting-frame portions 11*a* to 11*c* are connected to one another so as not to be relatively moved.

(Supporting-Fame Portion 11*a*)

The supporting-frame portion 11*a* possesses a rotation axis 11*x* and rotatably supports a hammer 12. The hammer 12 rotates about a rotation axis 11*x* (displayed with a dotted line in FIG. 3) serving as a center. The frame 11 and the hammer 12 are configured so that, when a strike-transmitting portion 55 extending downward from the white key 51W descends, an edge portion 12*b* on a side of the key-longitude front direction M2 of the hammer 12 descends (see FIG. 6A and FIG. 6B) and a tip portion 12*a* on a side of the key-longitude back direction M1 pivots and ascends.

(Supporting-Fame Portion 11*b*)

The supporting-frame portion 11*b* supports the supporting portion 14. The supporting portion 14 receives and supports, from a downwards direction, the portion on a side of the tip portion 12*a* of the hammer 12 which descends due to gravity when the white key 51W is in an unstruck state. The supporting portion 14 extends in the scale direction S. The hammer is designed so that the portion on the side of the key-longitude back direction M1 is longer than the portion on the side of the key-longitude front direction M2 with respect to the axis 11X as a reference. Therefore, the hammer 12 is configured so that the tip portion 12*a* is positioned lower than the rotation axis 11*x* in an unstruck state due to gravity. In addition, the supporting portion 14 determines a lower limit of the pivoting range of the tip portion 12*a* of the hammer 12.

(Supporting-Fame Portion 11*c*)

The supporting-frame portion 11*c* supports a hammer stopper 13. The hammer stopper 13 makes contact with the portion of the hammer 12 on the side of the tip portion 12*a* when the white key 51W is in a struck state (FIG. 6B). The hammer stopper 13 as well as the supporting frame 11*c* also extend in the scale direction S.

3. Key and Connection Portion

Figures 4A, 4B, 4C:
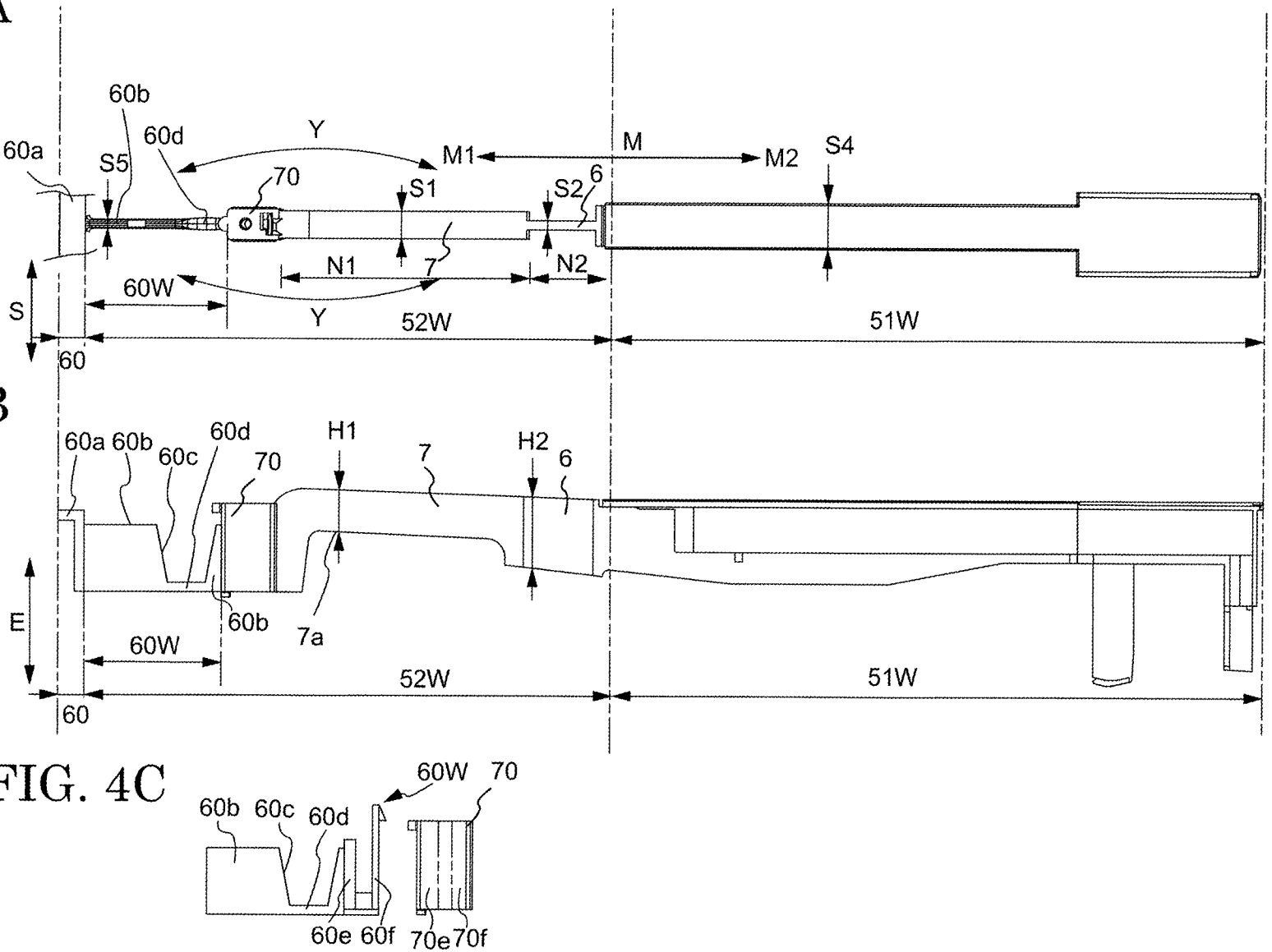
FIG. 4A is a plane view of a white key.
FIG. 4B and FIG. 4C are each a side view of a white key.
Figure 5A:
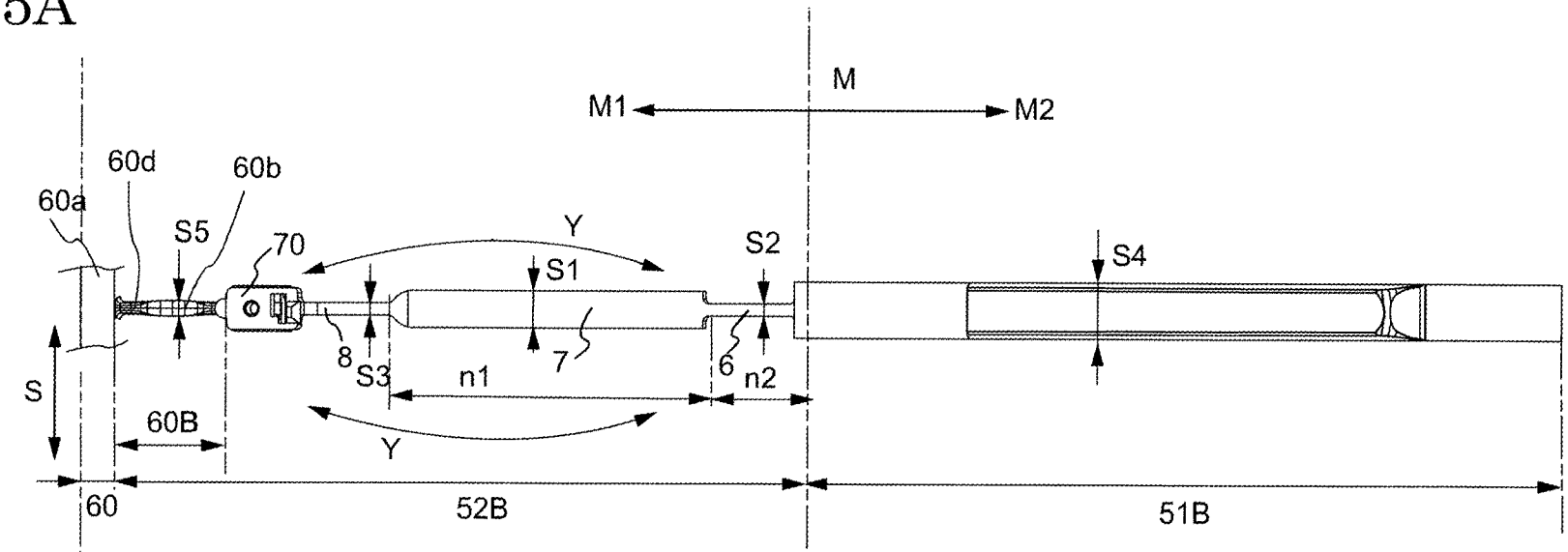
FIG. 5A and FIG. 5B are respectively a plane view and a side view of a black key.
Figure 5B:
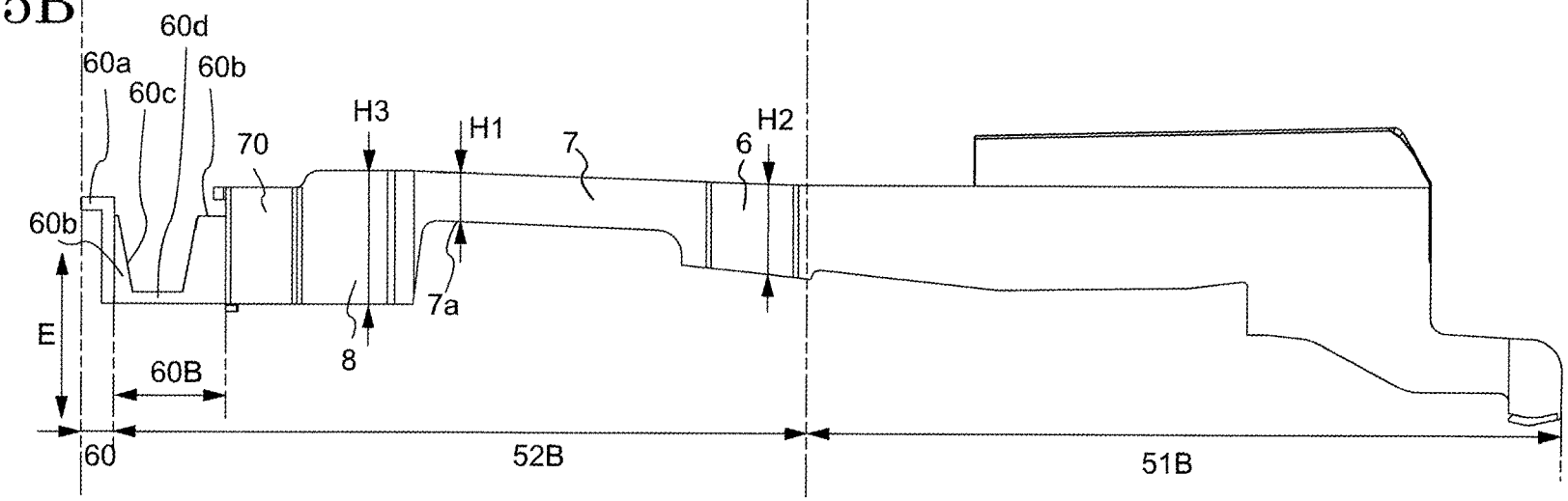

FIG. 4A is a plane view of the white key 51W, and FIG. 4B is a side view of the white key 51W. FIG. 4C is a side view showing a part of the structures of a linking portion 70 and the frame narrow-with portion 60W before linking. FIG. 5A is a plane view of the black key 51B, and FIG. 5B is a side view of the black key 51B. The white-key connection portion 52W connected to the white key 51W has a front-side narrow-width portion 6 (second region), a wide-width portion 7 (first region), and the linking portion 70, and the frame narrow-width portion 6 is provided to the frame 60. The black-key connection portions 52B connected to the black key 51B has a front-side narrow-width portion 6 (second region), a wide-width portion 7 (first region), and a back-side narrow-width portion 8 (second region), and the frame narrow-width portion 60B is provided to the frame 60.

3-1. White Key (Frame Narrow-Width Portion)

The frame narrow-width portion 60W has a flexible portion 60*b* (second region) extending from the supporting portion 60*a* and having flexibility in the scale direction S and a flexible portion 60*d* having flexibility in the scale direction S and the vertical direction E. Here, the portion other than the flexible portion 60*d* of the frame narrow-width portion 60W corresponds to the flexible portion 60*b*, and a cutoff portion 60*c* corresponds to a part of rims of the flexible portion 60*b* and the flexible portion 60*d*. The key 51 and the connection portion 52 are capable of rotating in the vertical direction E about the flexible portion 60*d* (see FIG. 4B and FIG. 5B).

Note that the frame narrow-width portion 60W and the linking portion 70 shown in FIG. 4C are linked to each other. The linking is performed by inserting a first insertion portion 60*e* of the frame narrow-width portion 60W into an insertion hole 70*e* of the linking portion 70 and inserting a second insertion portion 60*f* of the frame narrow-width portion 60W into an insertion hole 70*f* of the linking portion 70. The attachment-detachment mechanism of FIG. 4C is also applied to the attachment-detachment mechanism between the frame narrow-width portion 60B and the linking portion 70 with respect to the black key 51B.

(Front-Side Narrow-Width Portion)

The front-side narrow-width portion 6 (also called a second region, a first narrow-width portion, or a first low-rigidity portion) is a portion extending from the white key 51W in the key-longitude back direction M1. A width S2 of the front-side narrow-width portion 6 in the scale direction S is smaller than a width S4 of the white key 51W in the scale direction S. In addition, the width S2 of the front-side narrow-width portion 6 in the scale direction S is adjusted to a size smaller than a thickness H2 of the front-side narrow-width portion 6 in the vertical direction E. In brief, the front-side narrow-width portion 6 is disposed so that a thin plate-shaped member is vertically arranged.

Hence, the front-side narrow-width portion 6 has lower rigidity in the scale direction S than the white key 51W, exhibits flexibility in the scale direction S and a yawing direction Y, and is readily bent because the width S2 in the scale direction S is small. The structure of the front-side narrow-width portion in the case of the black key 51B is the same as that in the case of the white key 51W.

(Wide-Width Portion)

The wide-width portion 7 (also called a first region or a high-rigidity region) is a portion extending from the front-side small-width portion 6 on the side of the white key 51W in the key-longitude back direction M1. A width S1 of the wide-width portion 7 in the scale direction S is larger than the width S2 of the front-side narrow-width portion 6 in the scale direction S.

One of the reasons for the large width of the wide-width portion 7 in the scale direction S is represented as follows. One reason is the need to reproduce the feeling of striking a key similar to that of an acoustic piano. This purpose can be achieved by setting the length of the key to the rotation center to be long to allow the deformation of the key to be released by the flexibility of the vertical hinge as described in the Background, for example. However, when the length of the vertical hinge is set to be long, the entire rigidity of the vertical hinge is decreased. Therefore, in the present embodiment, rigidity of the connection portion 52W is improved by forming a part of the connection portion 52W in the key-longitude direction M so as to have a large width, while the other portion in the key-longitude direction M is adjusted to have a small width so that the connection portion 52W has flexibility.

The wide-width portion 7 has higher rigidity in the scale direction S than the front-side narrow-width portion 6 because the width S1 in the scale direction S is large. Thus, it is possible to reproduce a feeling of striking a key similar to an acoustic piano. Note that the width S1 of the wide-width portion 7 in the scale direction S is set to be smaller than the width S4 of the key 51 in the scale direction S.

The wide-width portion 7 has a depressed portion 7*a* caved upward in a side view. That is, the wide-width portion 7 has a depressed portion at a bottom surface thereof. Rigidity of the wide-width portion 7 is reduced due to the depressed portion 7*a*. However, high rigidity can be maintained because the wide-width portion 7 is fabricated so as to have the width S1 larger than that of the front-side narrow-width portion 6. The front-side narrow-width portion 6 and the frame narrow-width portion 60W may be formed in at least a part of the region other than the depressed portion 7*a*.

Note that the width S1 of the wide-width portion 7 in the scale direction S is adjusted to have a size smaller than a thickness H1 of a thin portion in the vertical direction E in which the depressed portion 7*a* is provided to the wide-width portion 7. In brief, the wide-width portion 7 is disposed so that a thin plate-shaped member is vertically arranged. In addition, the thickness H1 of the wide-width portion 7 in the vertical direction E is smaller than the thickness H2 of the front-side narrow-width portion 6 in the vertical direction.

3-2. Black Key

Hereinafter, the black key 51B is explained with reference to FIG. 5A and FIG. 5B.

(Wide-Width Portion)

Although the structure of the wide-width portion 7 in the case of the black key 51B is the same as that in the case of the white key 51W, a length n1 of the wide-width portion 7 of the black-key connection portion 52B connected to the black key 51B in the key-longitude direction M is set to be shorter than a length N1 of the wide-width portion 7 of the white-key connection portion 52W in the key-longitude direction M. A reason is that the length of the black key 51B in the key-longitude direction M is set to be shorter than that of the white key 51W. Additionally, the lengths n1 and N1 of the wide-width portion 7 in the key-longitude direction M are set to be respectively longer than lengths n2 and N2 of the front-side narrow-width portion 6 in the key-longitude direction M in both of the black-key connection portion 52B and the white-key connection portion 52W.

(Back-Side Narrow-Width Portion)

Next, the back-side narrow-width portion 8 of the black-key connection portion 52B is explained. The back-side narrow-width portion 8 (also called a second region, a second narrow-width portion, or a second low-rigidity portion) is a portion extending from the wide-width portion 7 in the key-longitude back direction M1. A wide S3 of the back-side narrow-width portion 8 in the scale direction S is smaller than the width S1 of the wide-width portion 7 in the scale direction S and the width S4 of the black key 51B in the scale direction S. Moreover, the width S3 of the back-side narrow-width portion 8 in the scale direction S is adjusted to have a size smaller than a thickness H3 of the back-side narrow-width portion 8 in the vertical direction E. In brief, the back-side narrow-width portion 8 is disposed so that a thin plate-shaped member is vertically arranged.

Hence, it can be said that the back-side narrow-width portion 8 has lower rigidity in the scale direction S than the wide-width portion 7, has flexibility in the scale direction S and the yawing direction Y, and has a shape readily bent in the scale direction S because of the small width S3 in the scale direction S.

In the present embodiment, the width S3 of the back-side narrow-width portion 8 in the scale direction S is set to be substantially the same as the width S2 of the front-side narrow-width portion 6 in the scale direction S. However, the width S3 of the back-side narrow-width portion 8 in the scale direction S may be smaller or larger than the width S2 of the front-side narrow-width portion 6 in the scale direction S.

As described above, the width S2 of the front-side narrow-width portion 6 in the scale direction S is smaller than the width S1 of the wide-width portion 7 in the scale direction S. Hence, the front-side narrow-width portion 6 has lower rigidity in the scale direction S than the wide-width portion 7, has flexibility in the scale direction S and the yawing direction Y, and is readily bent. In addition, the width S1 of the wide-width portion 7 in the scale direction S is larger not only than the width S3 of the back-side narrow-width portion 8 in the scale direction S but also larger than the width S5 of the frame narrow-width portions 60W and 60B in the scale direction S. Therefore, the wide-width portion 7 has higher rigidity than the back-side narrow-width portion 8 in the scale direction S. Moreover, the thickness H1 of the wide-width portion 7 in the vertical direction is smaller than the thickness H3 of the back-side narrow-width portion 8 in the vertical direction.

The white key 51W according to the present embodiment has a structure in which the front-side narrow-width portion 6 is arranged on the side of the key-longitude front direction M2 (front side) of the wide-width portion 7, while the frame narrow-width portion 60W is arranged on the side of the key-longitude back direction M1 (far side). When the white key 61W is deformed in the yawing direction Y, the positional relationship between the connection portion 52 (see FIG. 2) and the frame 60 is shifted. The front-side narrow-width portion 6 and the frame narrow-width portion 60W are deformed to provide a function to suppress the influence of the shift of the positional relationship. When the front-side narrow-width portion 6 is compared with the frame narrow-width portion 60W, the front-side narrow-width portion 6 closer to the white key 51W significantly contributes to realization of the function. Hence, the connection portion 52 may be configured so that the supporting portion 60*a*, the flexible portion 60*d*, and the wide-width portion 7 are arranged in this order in the key-longitude direction M in which the flexible portion 60*b* and the linking portion 70 are not employed.

Additionally, the black key 51B according to the present embodiment has a structure in which the front-side narrow-width portion 6 is arranged on the side of the wide-width portion 7 in the key-longitude front direction M2 (front side), while the back-side narrow-width portion 8 and the frame narrow-width portion 60B are arranged on the side of the wide-width portion 7 in the key-longitude front direction M1 (far side) of the wide-width portion 7. When the black key 51B is deformed in the yawing direction Y, the positional relationship between the connection portion 52 (see FIG. 2) and the frame 60 is shifted. The front-side narrow-width portion 6, the back-side narrow-width portion 8, and the frame narrow-width portion 60B are deformed to provide a function to suppress the influence of the shift of the positional relationship. When the front-side narrow-width portion 6 is compared with the back-side narrow-width portion 8 and the frame narrow-width portion 60B, the front-side narrow-width portion 6 closer to the black key 51B significantly contributes to realization of the function. Hence, the connection portion 52 may be configured so that the supporting portion 60*a*, the flexible portion 60*d*, and the wide-width portion 7 are arranged in this order in the key-longitude direction M in which the flexible portion 60*b*, the linking portion 70, and the back-side narrow-width portion 8 are not employed.

3-3. Attachment and Detachment of the Connection Portion

In the connection portion 52W of the white key 51W, the front-side narrow-width portion 6, the wide-width portion 7, the linking portion 70, and the frame narrow-width portion 60W are arranged in this order in the key-longitude direction M. Among these elements, the front-side narrow-width portion 6, the wide-width portion 7, and the linking portion 70 are integrally formed. The linking portion 70 integrally formed with the wide-width portion 7 is linked to the frame narrow-width portion 60W so as to be attachable thereto and detachable therefrom.

Note that the present embodiment is not limited to this structure: the front-side narrow-width portion 6, the wide-width portion 7, the linking portion 70, and the frame narrow-width portion 60W may have a structure in which these elements are integrally formed and cannot be attached to nor detached from one another or a structure in which these elements are individually prepared. Furthermore, similar to the black key 51B, the back-side narrow-width portion 8 may be provided to the white key 51W.

In the connection portion 52B of the black key 51B, the front-side narrow-width portion 6, the wide-width portion 7, the back-side narrow-width portion 8, the linking portion 70, and the frame narrow-width portion 60B are arranged in this order. Among these elements, the front-side narrow-width portion 6, the wide-width portion 7, the back-side narrow-width portion 8, and the linking portion 70 are integrally formed.

The linking portion 70 integrally formed with the back-side narrow-width portion 8 is linked to the frame narrow-width portion 60B so as to be attachable thereto and detachable therefrom. The back-side narrow-width portion 8 is positioned in the key-longitude front direction M2 from the linking portion 70, and the frame narrow-width portion 60B is positioned on the key-longitude back direction M1 from the linking portion 70.

Note that the present embodiment is not limited to this structure: the front-side narrow-width portion 6, the wide-width portion 7, the back-side narrow-width portion 8, the linking portion 70, and the frame narrow-width portion 60W may have a structure in which these elements are integrally formed and cannot be attached to nor detached from one another or a structure in which these elements are individually prepared so as to be attached to or detached from one another. Furthermore, similar to the white key 51W, the black key 51B may be structured without the back-side narrow-width portion 8.

Note that, although the structure is explained in this embodiment in which the connection portion 52W and the connection portion 52B each have the linking portion 70, the present embodiment is not limited to this structure: the connection portion 52W may not have the linking portion 70, and the wide-width portion 7 and the frame narrow-width portion 60W may be integrally formed so as not to be attached to or detached from each other.

In the case of the white key 51W, the linking portion 70 is disposed between the wide-width portion 7 and the frame narrow-width portion 60W in the key-longitude direction M as described above. The linking portion 70 is arranged between the back-side narrow-width portion 8 and the frame narrow-width portion 60B in the key-longitude direction M in the case of the black key 51B. There is such a difference between the white key 51W and the black key 51B. However, the length of the frame narrow-width portion 60W of the connection portion 52W of the white key 51W is substantially the same as the summation of the lengths of the back-side narrow-width portion 8 and the frame narrow-width portion 60B of the connection portion 52B of the black key 51B in the key-longitude direction M.

As shown in FIG. 4B, the frame narrow-width portion 60W has the cutoff portion 60*c* caved downward. Furthermore, the frame narrow-width portion 60B has a cutoff 60*c* caved downward as shown in FIG. 5B. These cutoff portions 60*c* enable the white key 51W and the black key 51B to be readily rotated in the vertical direction E.

4. Hammer Mechanism

Figure 6A:
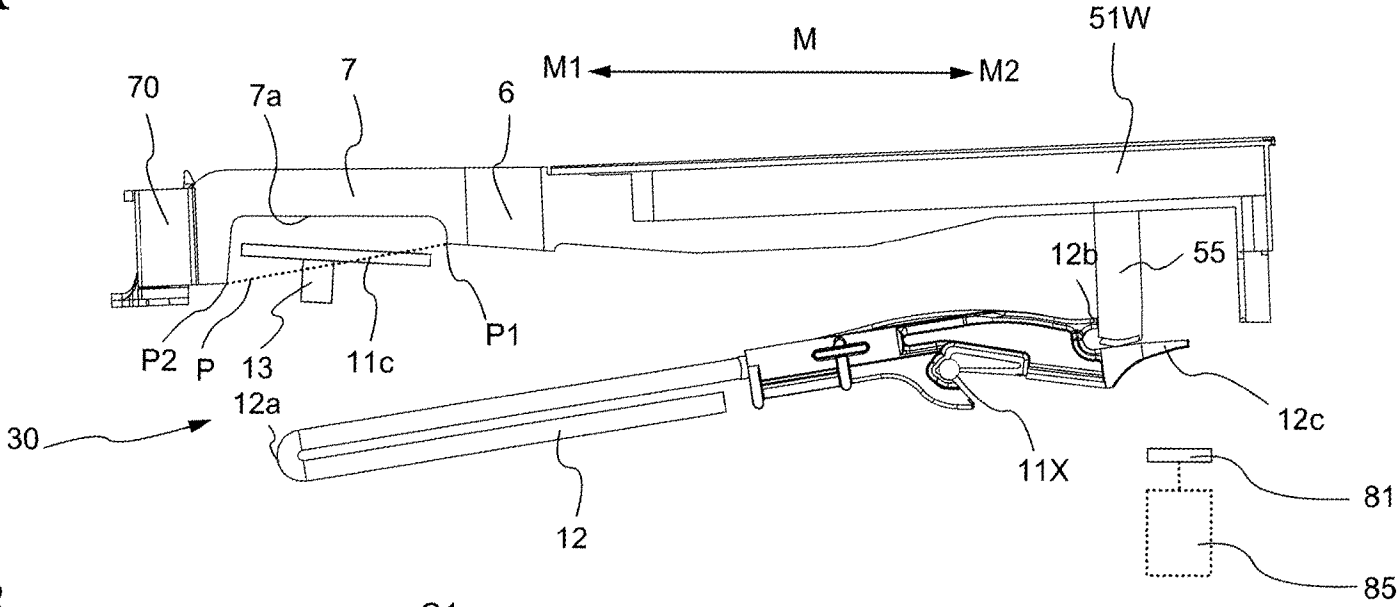
FIG. 6A and FIG. 6B are side views showing a positional relationship between a white key and a hammer when the white key is in an unstruck state and a struck state, respectively.
Figure 6B:
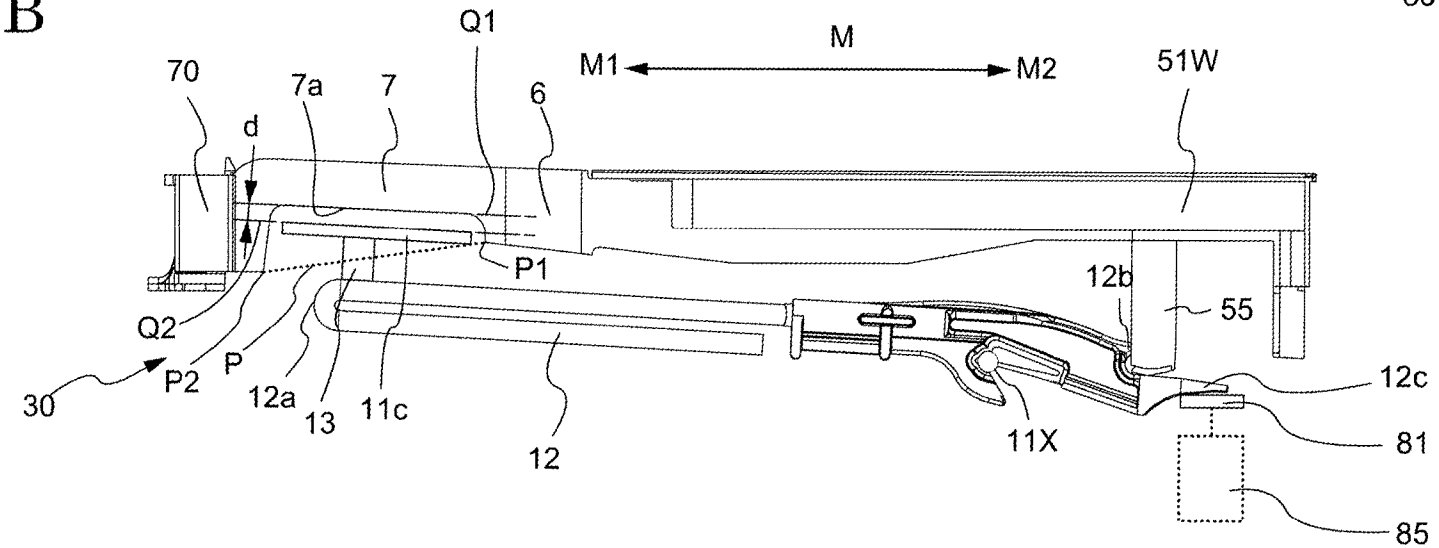

FIG. 6A is a side view showing a positional relationship between the white key 51W and the hammer 12 when the white key 51W is in an unstruck state. FIG. 6B is a side view showing a positional relationship between the white key 51W and the hammer 12 when the white key 51W is in a struck state. The hammer mechanism 30 is structured so as to include at least the hammer 12 operated according to a strike of the white key 51W and the hammer stopper 13 regulating the movement of the hammer. The hammer mechanism 30 further includes the supporting frame portion 11*c* and the supporting portion 14 in addition to these elements.

(Positional Relationship Between the Hammer Mechanism and the Depressed Portion)

The depressed portion 7*a* described above is caved in order to escape from (not to bump into) at least a part of the hammer stopper 13 which is in contact with the hammer 12 and the supporting frame 11*c* supporting the hammer stopper 13.

The supporting frame 11*c* is arranged substantially parallel to the depressed portion 7*a* when the white key 51W is in a stuck state (FIG. 6B). In this state, the most depressed surface denoted by a virtual line Q1 in the depressed portion 7*a* approaches the surface of the supporting frame 11*c* denoted by a virtual line Q2 by a distance d. Such a structure which makes the depressed portion 7*a* and the supporting frame 11*c* be positioned as close as possible when the white key 51W is struck allows the space under the key 51 to be efficiently used and the redundant space to be reduced to a value corresponding to the distance d. Note that it is not always necessary to arrange the supporting frame 11*c* and the depressed portion 7*a* in parallel as long as they are configured to approach each other as close as possible.

In addition, the hammer 12 possesses a sensor strike-transmitting portion 12*c* on the side of the key-longitude front direction M2 from the rotation axis 11X. A sensor 81 for sensing a strike (operation) of the key 51 is arranged under the sensor strike-transmitting portion 12*c*. The sensor 81 as well as a sound-source device 85 connected to the sensor 81 is explained below.

Figure 9:
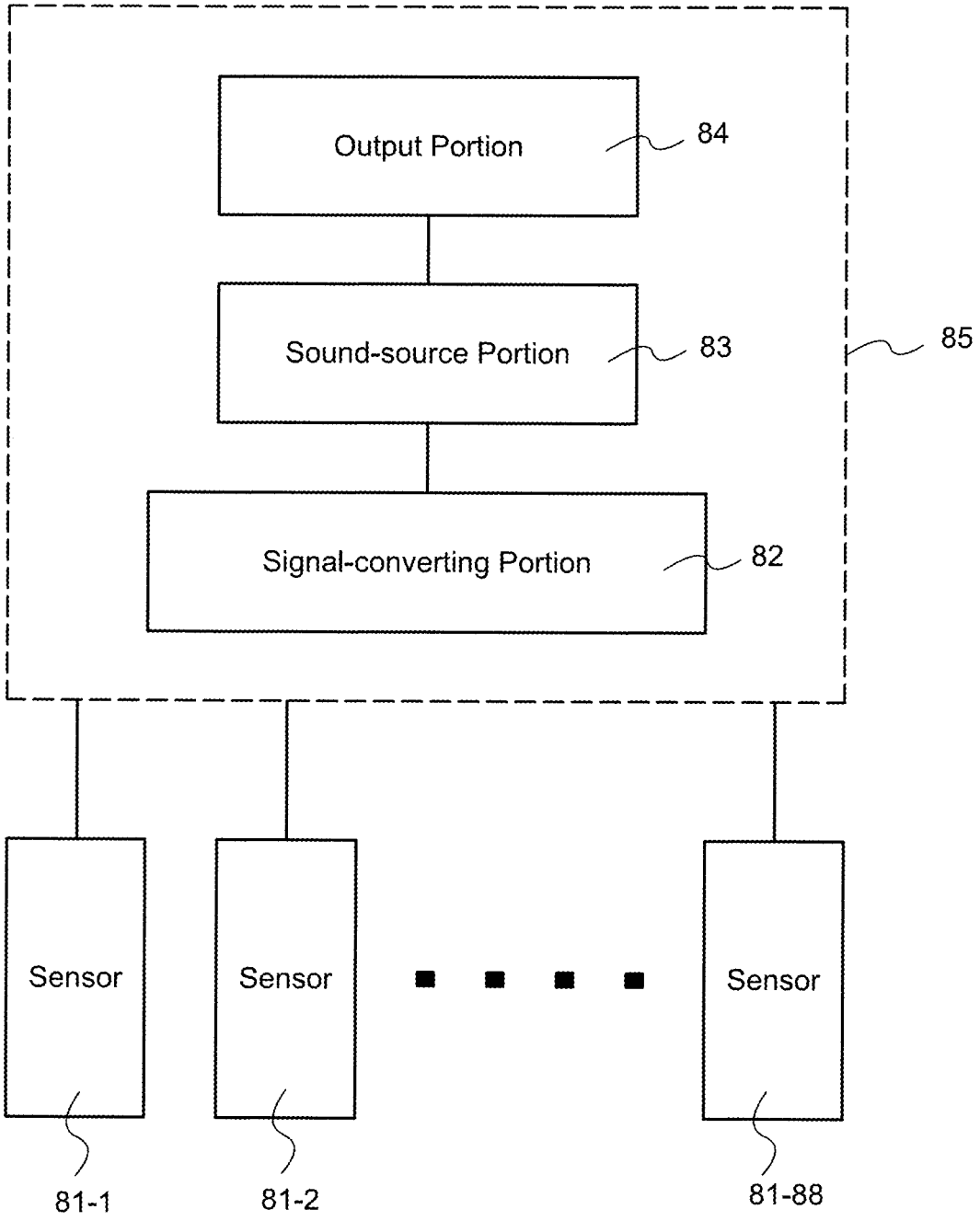
FIG. 9 is a block diagram showing a structure of a sound-source device.

FIG. 9 is a block diagram showing a structure of the sound-source device 85. The sound-source device 85 has a signal-converting portion 82, a sound-source portion 83, and an output portion 84. The sensors 81 are provided to the respective keys 51, detect the operation of the keys, and output signals corresponding to the detected content. In this example, the sensors 81 output signals in accordance with the striking amount of the key having three steps. It is possible to detect the rate of a key strike according to an interval between the signals.

The signal-converting portion 82 obtains the output signals of the sensors 81 (sensors 81-1 to 81-88 corresponding to 88 keys 51), generates operation signals corresponding to the operation state of each key 51, and outputs the operation signals. In this example, the operation signals are signals with a MIDI format. Therefore, the signal-converting portion 82 outputs a note-ON according to the key operation. At this time, a key number showing the operated key among the 88 keys 51 and velocity corresponding to the rate of the key strike are associated with the note-ON and output. The signal-converting portion 82 associates the key number with a note OFF according to the key operation and outputs the note-OFF. Signals corresponding to other operations such as a pedal operation are input to the signal-converting portion 82, and these signals may be reflected in the operation signals.

The sound-source portion 83 generates sound-wave signals on the basis of the operation signals output from the signal-converting portion 82. The output portion 84 outputs the sound-wave signals generated by the sound-source portion 83. The sound-wave signals are output to a speaker or an output terminal for a sound-wave signal which are not illustrated, for example.

Here, turning to the explanation of FIG. 6B, the hammer mechanism 30 is configured so that a part thereof is positioned in the depressed portion 7*a* of the wide-width portion 7 when the white key 51W is in a struck state as described above. The state where a part of the hammer mechanism 30 is positioned in the depressed portion 7*a* means that the part of the hammer mechanism 30 is positioned in a region surrounded by a virtual line P (illustrated with a dotted line. The same is applied hereinafter.) connecting one end portion P1 and the other end portion P2 of the depressed portion 7*a* in the key-longitude direction M and the depressed portion 7*a*.

Specifically, the hammer mechanism 30 is configured so that the hammer stopper 13 is arranged so as to be located in the depressed portion 7*a* of the wide-width portion 7 when the key 51 is in the struck state in the present embodiment (see FIG. 6B). In addition, the hammer stopper 13 is arranged so as to be positioned in the depressed portion 7*a* of the wide-width portion 7 even in the state where the key 51 is not struck in the present embodiment (see FIG. 6A). Note that the hammer mechanism 30 may be configured so that the hammer stopper 13 is not positioned in the depressed portion 7*a* of the wide-width portion 7 in the state where the key 51 is not struck but is positioned in the depressed portion 7*a* of the wide-width portion 7 after the key 51 is struck.

This hammer stopper 13 has a function to regulate an upper limit position of the raising tip portion 12*a* when a player strikes the white key 51W. Moreover, the hammer stopper 13 is provided so as to make contact with the hammer 12 in order to allow a player to obtain the feeling of striking a key of a ground piano when the player strikes the white key 51W.

(Positional Relationship of the Tip Portion of the Hammer and the Depressed Portion)

Figure 7A:
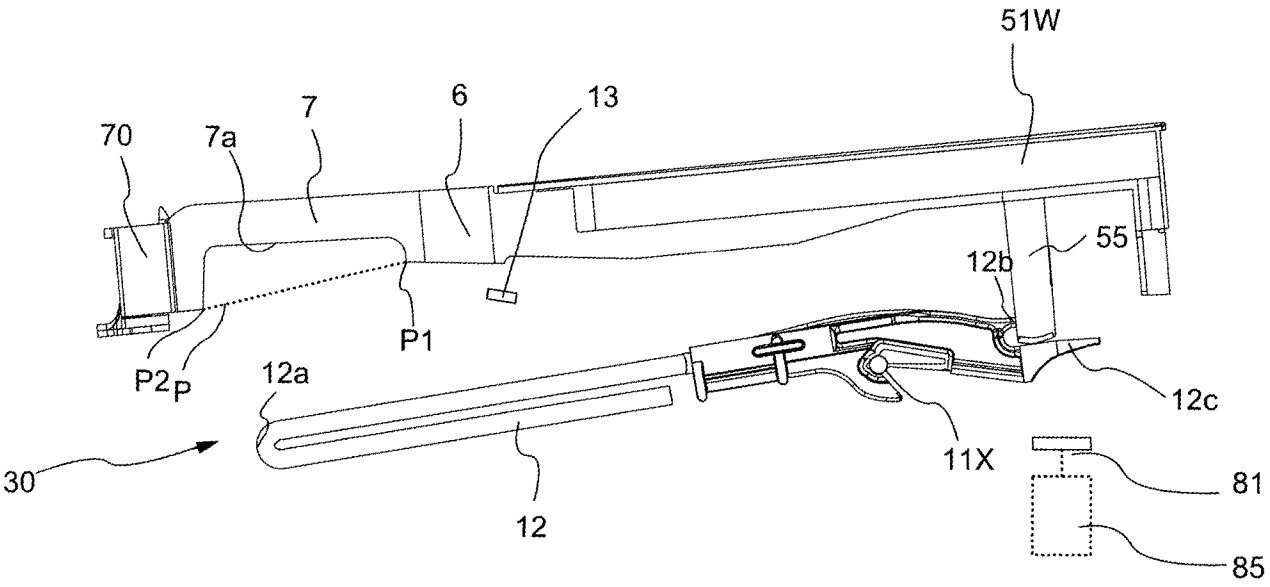
Figure 7B:
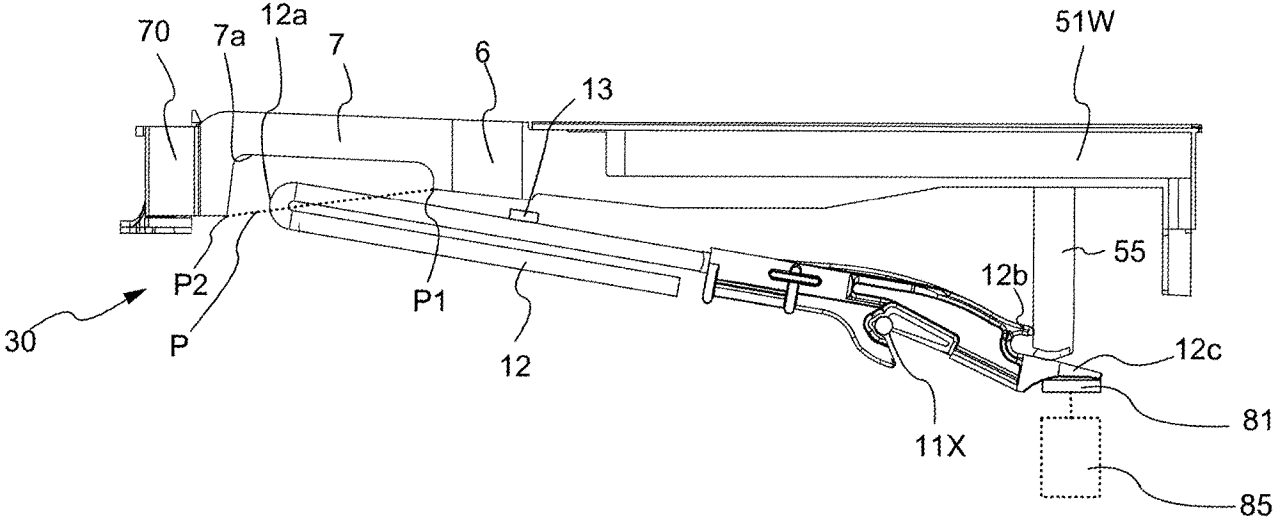

FIG. 7A and FIG. 7B are drawings of the keyboard device 100 according to a modified example of the First Embodiment of the present invention. FIG. 7A and FIG. 7B are side views showing a positional relationship between the white key 51W and the hammer 12 when the white key 51W is in an unstruck state and a struck state, respectively.

In this modified example, a part of the hammer 12 is positioned in the depressed portion 7*a* of the wide-width portion 7 in the state where the key 51 is struck (see FIG. 7B). However, a part of the hammer 12 may be located in the depressed portion 7*a* of the wide-width portion 7 in the state where the key 51 is not struck. In addition, the hammer 12 may be configured so that, although a part of the hammer 12 is not located in the depressed portion 7*a* of the wide-width portion 7 in the state where the key 51 is not struck, the part of the hammer 12 enters the depressed portion 7*a* of the wide-width portion 7 after the key 51 is struck (see FIG. 7A and FIG. 7B). Note that in the case of the structure of FIG. 7A and FIG. 7B, the position of the hammer stopper 13 is not in the depressed portion 7*a* but under the white key 51W.

Second Embodiment

Figure 8A:
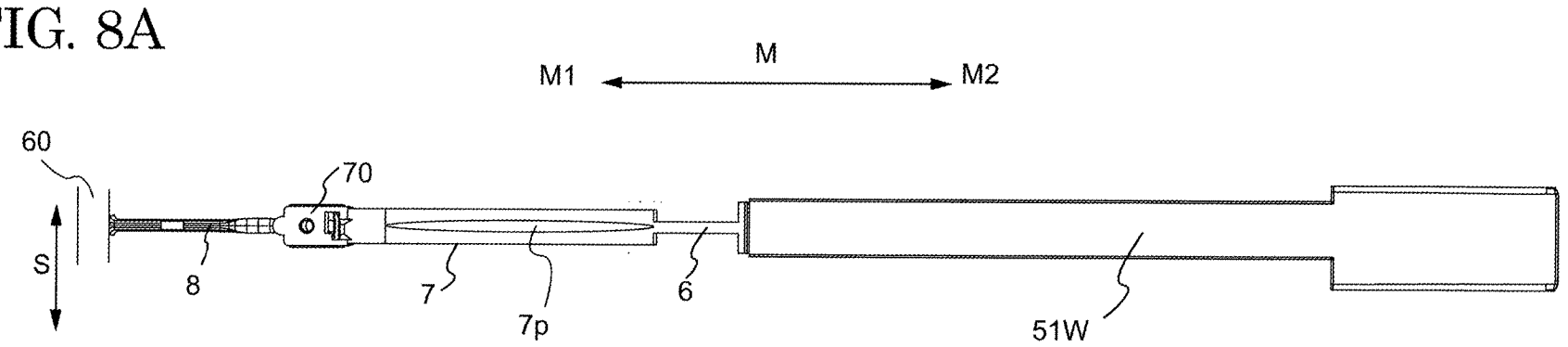
FIG. 8A is a plane view of a white key according to the Second Embodiment.
Figure 8B:
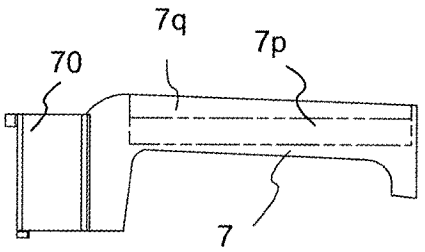
FIG. 8B is a side view of a part of the white key.

FIG. 8A is a cross-sectional view of the white key 51W according to the Second Embodiment viewed from above. FIG. 8B is a side view of a part of the connection portion 52W of the white key. The wide-width portion 7 has a space 7*p* therein. This structure reduces material costs. Furthermore, a housing 7*q* is arranged over the space 7*p*. Note that, although the connection portion 52W has the structure where the wide-width portion 7 has the space 7*p* in the present embodiment, the structure of the connection portion 52W is not limited thereto, and the connection portion 52W may have a structure in which another material is filled in the wide-width portion 7.

Third Embodiment

Figure 8C:
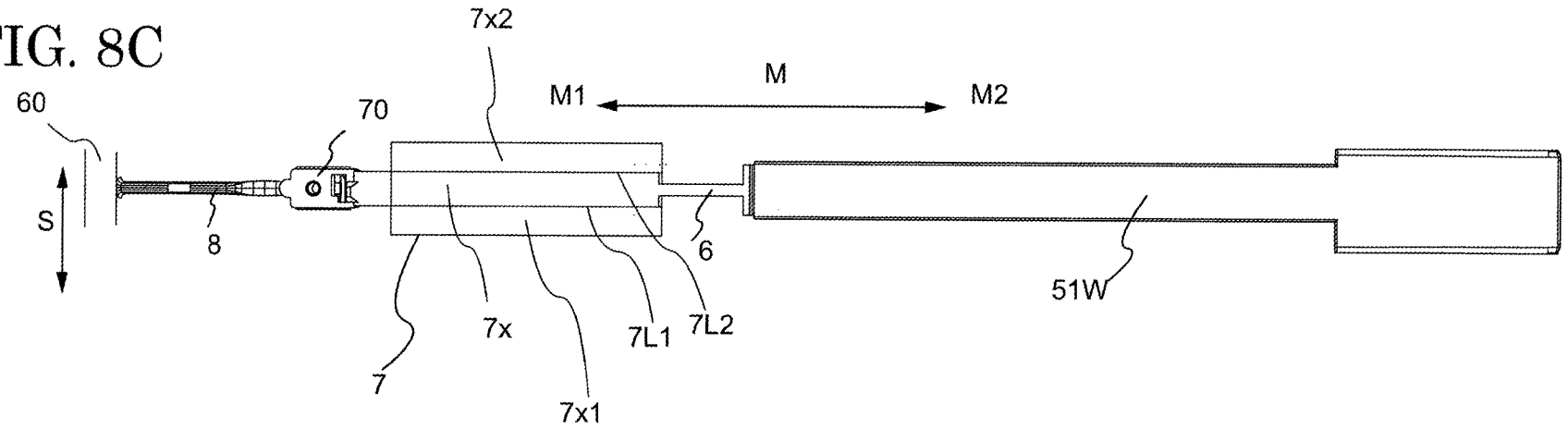
FIG. 8C is a plane view of a white key according to the Third Embodiment.

FIG. 8C is a plane view of the white key 51W according to the Third Embodiment. The wide-width portion 7 possesses an extending portion 7*x* extending from the narrow-width portion 6 in the key-longitude back direction M1, a stuck portion 7*x*1 stuck on one side surface 7L1 of the extending portion 7*x*, and a stuck portion 7*x*2 stuck on the other side surface 7L2 of the extending portion 7*x*.

Note that although the wide-width portion 7 has a structure in which the stuck portions 7*x*1 and 7*x*2 are respectively stuck on the one side surface 7L1 and the other side surface 7L2 of the extending portion 7*x* in the present embodiment, the structure of the wide-width portion 7 is not limited thereto: a structure may be employed where the stuck portion 7*x*1 is stuck only on the one side surface 7L1 of the extending portion 7*x*, that is, one of the side surfaces of the extending portion 7*x*.

According to any structure of the First to Third Embodiments, rigidity of the wide-width portion 7 (high-rigidity portion) in the vertical direction E increases with increasing width of the wide-width portion 7 in the scale direction S. Moreover, the front-side narrow-with portion 6 and the back-side narrow-width portion 8 which are the most flexible portions in the scale direction S are formed in the connection portion 52 in the keyboard device 100. Hence, the keyboard device 100 possesses the keys having high rigidity in the vertical direction E while maintaining flexibility in the scale direction S.

Furthermore, according to the structure of the Second Embodiment, materials cost can be reduced because the wide-width portion 7 encloses the space 7*p*. In addition, manufacture of the keyboard device 100 can be made easy according to the structure of the Third Embodiment.

In addition, according to any structure of the aforementioned First to Third Embodiments, the depressed portion 7*a* is provided in the connection portion 52. A part of the hammer mechanism 30 is located in the depressed portion 7*a* when the white key 51W or the black key 51B is struck. The depressed portions 7*a* of the white key 51W and the black key 51B can be utilized as a space for receiving a part of the hammer mechanism 30, by which wider rotation region of the hammer 12 can be secured. In addition, a heavy touch feeling of the key 51 can be realized.

A structure obtained by adding or deleting a structural element or conducting a design change on a structural element on the basis of the structure explained as an embodiment of the present invention as well as a method to which a process is added, from which a process is omitted, or on which a condition change is performed are included in the range of the present invention as long as they involve the concept of the present invention.

It is properly understood that another effect different from that provided by the modes of the aforementioned embodiments is achieved by the present invention if the effect is obvious from the description in the specification or readily conceived by persons ordinarily skilled in the art.

What is claimed is:

1. A keyboard, including a plurality of oblong keys arranged in a musical scale direction, for a musical keyboard instrument, the keyboard comprising:

an oblong key, among the plurality of oblong keys, with a longitudinal direction thereof extending along a front side and a rear side thereof and perpendicular to the scale direction of the keyboard; and an oblong connection portion including:

a first region extending in the longitudinal direction and with rigidity lower than the oblong key in the scale direction; and front and rear second regions sandwiching the first region and each with rigidity lower than the first region in the scale direction, wherein the oblong key, the front second region, the first region, and the rear second region extend along the longitudinal direction, and wherein a rear side of the oblong key is connected to the front second region.

2. The keyboard according to claim 1, wherein a width of the first region is smaller than a width of the oblong key, and a width of each of the front and rear second region is smaller than the width of the first region, each of the widths extending in the scale direction.

3. The keyboard according to claim 1, wherein flexibility of the first region is larger than flexibility of the oblong key in the scale direction.

4. The keyboard according to claim 1, wherein each of the front and rear second regions has flexibility in a yawing direction, which is along a top surface of the oblong key.

5. The keyboard according to claim 1, wherein the first region includes a recess extending upwardly from a bottom side thereof.

6. The keyboard according to claim 1, wherein the first region includes a cavity that forms a space therein.

7. The keyboard according to claim 1, wherein the first region comprises:

an extending portion extending from the front second region in the longitudinal direction; and a stuck portion extending laterally from one side surface of the first region.

8. A keyboard device, including a plurality of oblong keys arranged in a musical scale direction, for a musical keyboard instrument, the keyboard device comprising:

an oblong key, among the plurality of oblong keys, with a longitudinal direction thereof extending along a front side and a rear side thereof and perpendicular to the scale direction of the keyboard device; and an oblong connection portion including:

a first region extending in the longitudinal direction and with a width narrower than the oblong key in the scale direction; and front and rear second regions sandwiching the first region, each with flexibility in a yawing direction and a narrower width than the first region in the scale direction, wherein the oblong key, the front second region, the first region, and the rear second region extend along the longitudinal direction, and wherein the front second region is connected to a rear side of the oblong key and the rear second region is connected to a frame.

9. The keyboard device according to claim 8, wherein the first region includes a recess extending upwardly from a bottom side thereof.

10. The keyboard device according to claim 8, wherein the first region includes a cavity that forms a space therein.

11. The keyboard device according to claim 8, wherein the first region comprises:

an extending portion extending from the front second region in the longitudinal direction; and a stuck portion extending laterally from one side surface of the extending portion.

12. The keyboard device according to claim 8, wherein the keyboard device is an electronic keyboard device that includes:

a sensor sensing operation on the oblong key; and a sound-source portion generating a sound-wave signal according to an output signal of the sensor.

13. A keyboard device, including a plurality of oblong keys arranged in a musical scale direction, for a musical keyboard instrument, the keyboard device comprising:

an oblong key, among the plurality of oblong keys, with a longitudinal direction thereof extending along a front side and a rear side thereof and perpendicular to the scale direction of the keyboard device; and an oblong connection portion including:

a first region extending in the longitudinal direction and with rigidity lower than the oblong key in the scale direction; and front and rear second regions sandwiching the first region, and each with flexibility in a yawing direction and rigidity lower than the first region in the scale direction, wherein the oblong key, the front second region, the first region, and the rear second region extend along the longitudinal direction, and wherein the front second region is connected to a rear side of the oblong key and the rear second region is connected to a frame.

14. The keyboard device according to claim 13, wherein the first region includes recess extending upwardly from a bottom side thereof.

15. The keyboard device according to claim 13, wherein the first region includes a cavity that forms a space therein.

16. The keyboard device according to claim 13, wherein the first region comprises:

an extending portion extending from the front second region in the longitudinal direction; and a stuck portion extending laterally from one side surface of the extending portion.

17. The keyboard device according to claim 13, wherein the keyboard device is an electronic keyboard device that includes:

a sensor sensing operation on the oblong key; and a sound-source portion generating a sound-wave signal according to an output signal of the sensor.

* * * * *